US006364303B1

(12) United States Patent
Gustavson

(10) Patent No.: US 6,364,303 B1
(45) Date of Patent: Apr. 2, 2002

(54) MULTIFUNCTION WALLBOARD INSTALLATION TOOL

(76) Inventor: Ido H. Gustavson, P.O. Box 741, Micanopy, FL (US) 32667

( * ) Notice: Subject to any disclaimer, the term of this patent is extended or adjusted under 35 U.S.C. 154(b) by 0 days.

(21) Appl. No.: 09/802,060

(22) Filed: Mar. 9, 2001

(51) Int. Cl.[7] ..... B25B 1/20

(52) U.S. Cl. ..... 269/37; 269/102; 269/904; 52/702

(58) Field of Search ..... 269/37, 41–45, 269/101, 102, 904; 33/645–649; 248/300, 248, 544; 52/DIG. 1; 24/464

(56) References Cited

U.S. PATENT DOCUMENTS 4,237,614 A * 12/1980 Williams ..... 269/43
4,564,182 A * 1/1986 Svajgl ..... 269/904
5,088,682 A * 2/1992 Gibbs ..... 248/542
5,174,555 A * 12/1992 Lossing ..... 269/71
5,611,189 A * 3/1997 Fleck ..... 52/702
5,664,391 A * 9/1997 Bartholomew ..... 52/714
5,768,830 A * 6/1998 Kelly ..... 52/127.1
6,161,824 A * 12/2000 Gustavson ..... 269/43
6,209,280 B1 * 4/2001 Bruce et al. ..... 52/702

* cited by examiner

*Primary Examiner*—Joseph J. Hail, III
*Assistant Examiner*—Lee Wilson

(57) ABSTRACT

The present invention provides a simple tool capable of temporarily holding wallboard sections in of a variety of orientations while allowing final positional adjustment and permanent fastening. This capability allows the user reduce the number of tools required to do a variety of jobs. In one configuration the present tool has at least three support surfaces, a first offset from second and a third extending perpendicularly from the first second. The first and second surfaces are mutually offset such that when the first is mounted to a wall structure, the second support surface is appropriately spaced to receive and retain the edge of a section of sheathing. Guide surfaces are provided at the leading edge of each support surface to guide the sheathing edge into the space defined by an installed tool support surface and the wall structure. In one configuration a mounting plate is secured to the tool body to allow the tool to rotate when the mounting plate is rigidly mounted to a wall structure.

16 Claims, 4 Drawing Sheets

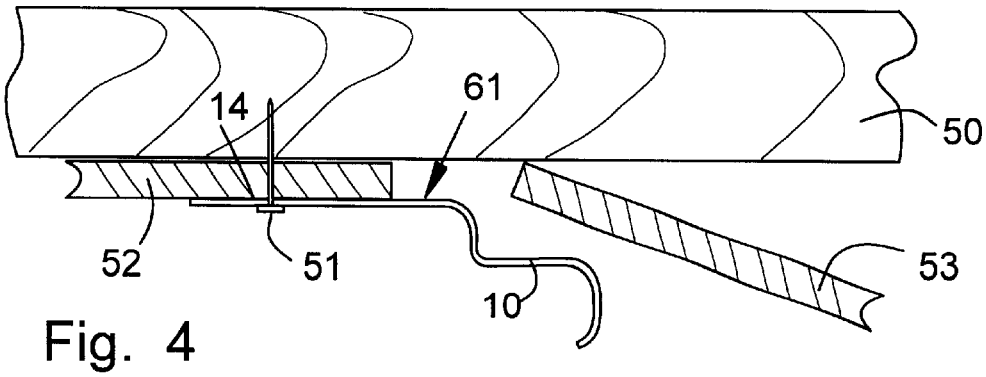
Fig. 4
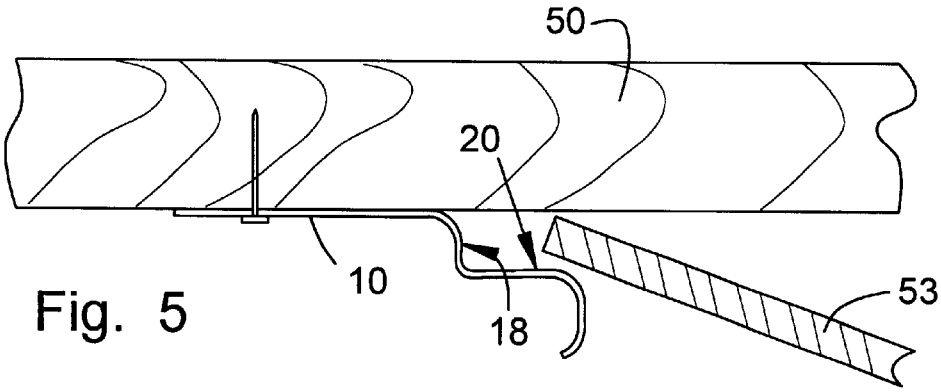
Fig. 5
Fig. 6
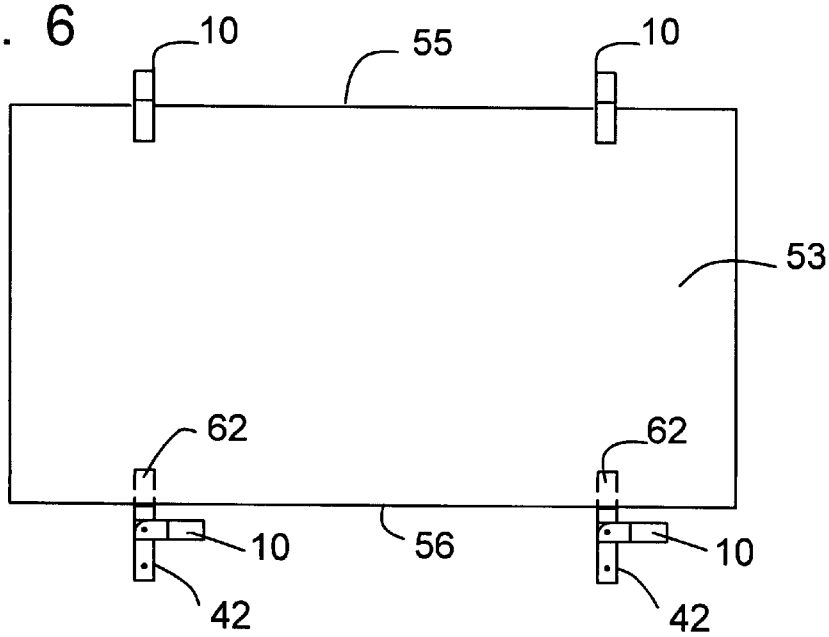

MULTIFUNCTION WALLBOARD INSTALLATION TOOL

BACKGROUND OF THE INVENTION

The present invention relates to tools used in the installation of building construction sheathing materials such as gypsum wallboard. In particular, the present invention pertains to tools and fixtures for temporarily retaining wallboard and similar materials in place against a building surface to facilitate installation.

Gypsum wallboard has been used for many decades as a sheathing material covering interior walls and ceilings in many kinds of building construction. Such wallboard typically comes in standard sizes; the most typical being four feet wide by eight feet long. The size and considerable weight of such gypsum wallboard pieces create difficulties for installers, whether professional or amateur. Prior to being permanently secured, any sheathing material must be placed in proper position and held securely while permanent fasteners are applied. Particularly in ceiling installations, placing and retaining a large wallboard section while installing fasteners requires considerable effort. For this reason, in most situations, gypsum wallboard must be installed by at least two workers. Even with multiple workers, it is often the case that before a wallboard section can be securely fixed in place, worker fatigue results in shifting or misplacement of the wallboard.

Various methods and devices have previously been employed to address this problem. It is a practice of some professionals to use a wood installation frame to support a wallboard section. The frame is then used to lift and press the wallboard section to the ceiling joists. This method is awkward and does not provide easy adjustment. Various jacking devices have been also employed for supporting and then raising wallboard sections to a ceiling. However, such devices do not work well with vertical walls or inclined ceilings and are unwieldy and expensive.

For these reasons a simple device is needed for temporarily retaining gypsum wallboard sections, or similar sheathing materials, against an existing structure, such as a ceiling or wall. The device should be mountable prior to placing a sheathing section and allow the sheathing to be easily adjusted and then retained in proper position without human effort. Such a device should be effective for installations on vertical, horizontal or inclined structures.

SUMMARY OF THE INVENTION

The present invention is a tool which enables one or more users to install large unwieldy sections of sheathing materials in any of a variety of orientations on walls or ceilings or inclined ceilings. The invention provides a simple tool capable of temporarily holding wallboard sections in any of these situations while allowing final positional adjustment and permanent fastening. Because the tool can accomplish multiple operations, the number of tools required to complete a variety of wallboard installation jobs is reduced. Additionally, on large construction jobs, efficiency can be gained by allocating to certain workers the task of placing sheathing using the present invention. Different following workers can work continuously at the specific task of securing the sheathing in place. In this way all individuals can work more efficiently.

In a preferred embodiment of the invention the tool has at least three support surfaces: a first surface is offset from a second surface and a third extends perpendicularly from the second. The first and second surfaces are mutually offset such that when the first is mounted to a wall structure, the second support surface is appropriately spaced to receive and retain the edge of a section of sheathing. The sheathing edge is positioned by a butting surface, between the first and second support surfaces. Guide surfaces are provided at the leading edge of each support surface to guide the sheathing edge into the space defined by an installed tool support surface and the wall structure. In the preferred embodiment, a mounting plate is secured to the tool body to allow the tool to rotate when the mounting plate is rigidly mounted to a wall structure. In alternative embodiments, a tool body without a separate mounting plate is used. A means of mounting the tool to a wall structure is provided, preferably in the form of a mounting hole through which a standard fastener may be driven.

DESCRIPTION OF THE DRAWINGS

FIGS. 4 and 5 depict various operations using the embodiment of FIG. 1 to install wallboard on walls.

FIG. 6 is a plan view showing the operation of the invention including both fixed and rotatable embodiments.

DESCRIPTION OF THE PREFERRED EMBODIMENTS

Figure 1:
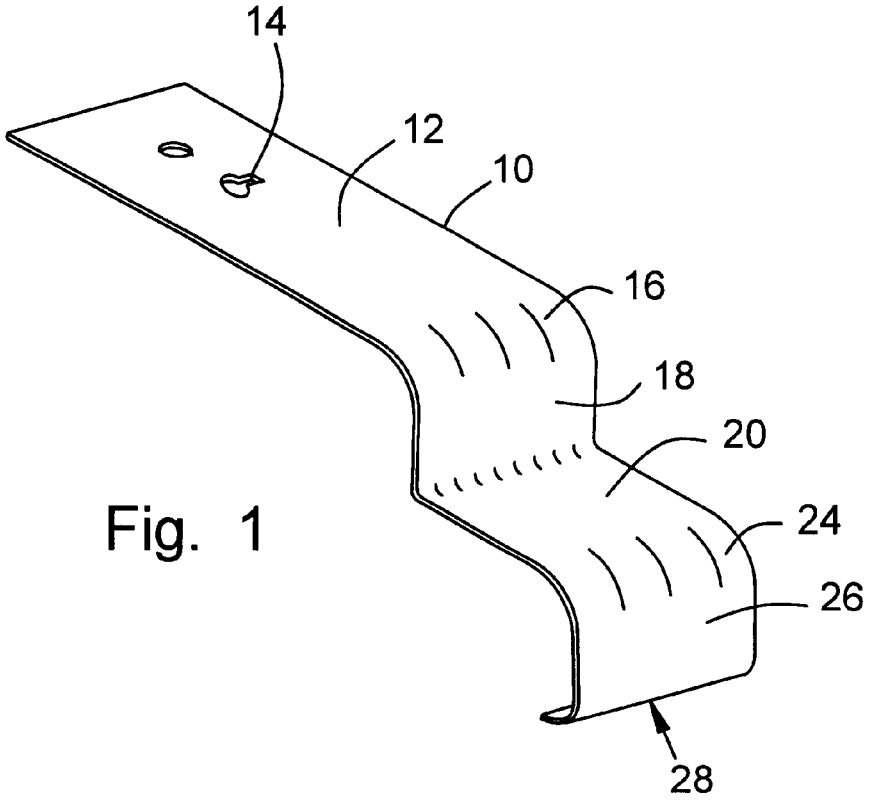
FIGS. 1 and 2 are orthographic and side views, respectively of one embodiment of the invention.
Figure 2:
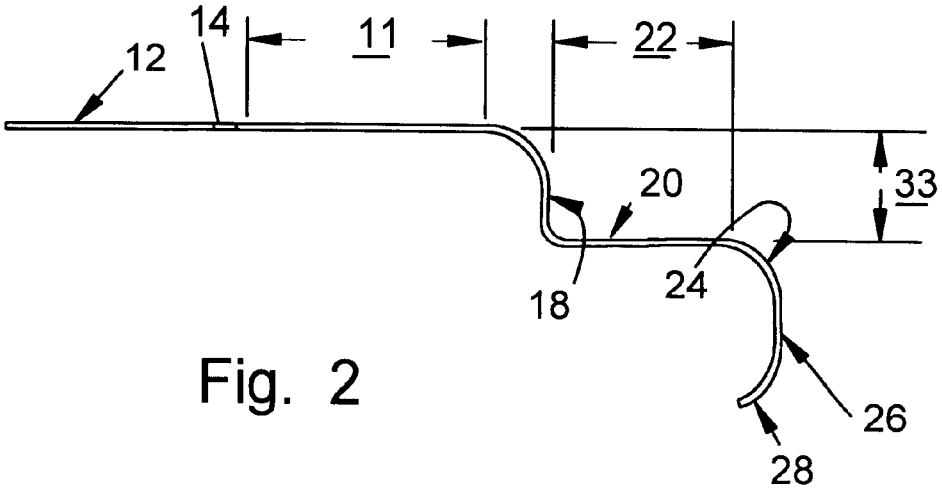

FIGS. 1 and 2 depict one embodiment of the present invention in which relatively thin sheet steel has been bent to form a tool body 10 having a series of support and guide surfaces. The tool body 10 has an upward facing upper support surface 12 that extends an upper support length 11 from a mounting hole 14 to a downward curving first guide surface 16. Herein, directional terms such as "upward" and "downward" are used to indicate only relative orientations and do not indicate any limitation of orientation in operation. Extending generally vertically downward from the opposite end of the first guide surface 16 is a butting surface 18. A lower support surface 20 extends from the lower end of the butting surface 18 a lower support length 22 to a downward curving second guide surface 24. The lower support surface 20 is spaced an offset dimension 33 below the upper support surface 12. The two support surfaces are also preferably mutually parallel. A lateral support surface 26 extends downward from the second guide surface 24 and terminates in a curved third guide surface 28. The use of sheet steel to form these surfaces is motivated by the ease of construction and low cost. In the configuration shown, the tool body is formed of sheet steel about 1.25 inches wide and about 3/32 inch thick. However, in other embodiments, the above surfaces are formed in tool bodies of alternative configuration and materials. For example, the above surfaces may be formed in a generally rectangular block of plastic, wood or other metals. Among metals, although steels may be used, lighter weight materials such as aluminum and titanium alloys are preferred.

Figure 3:
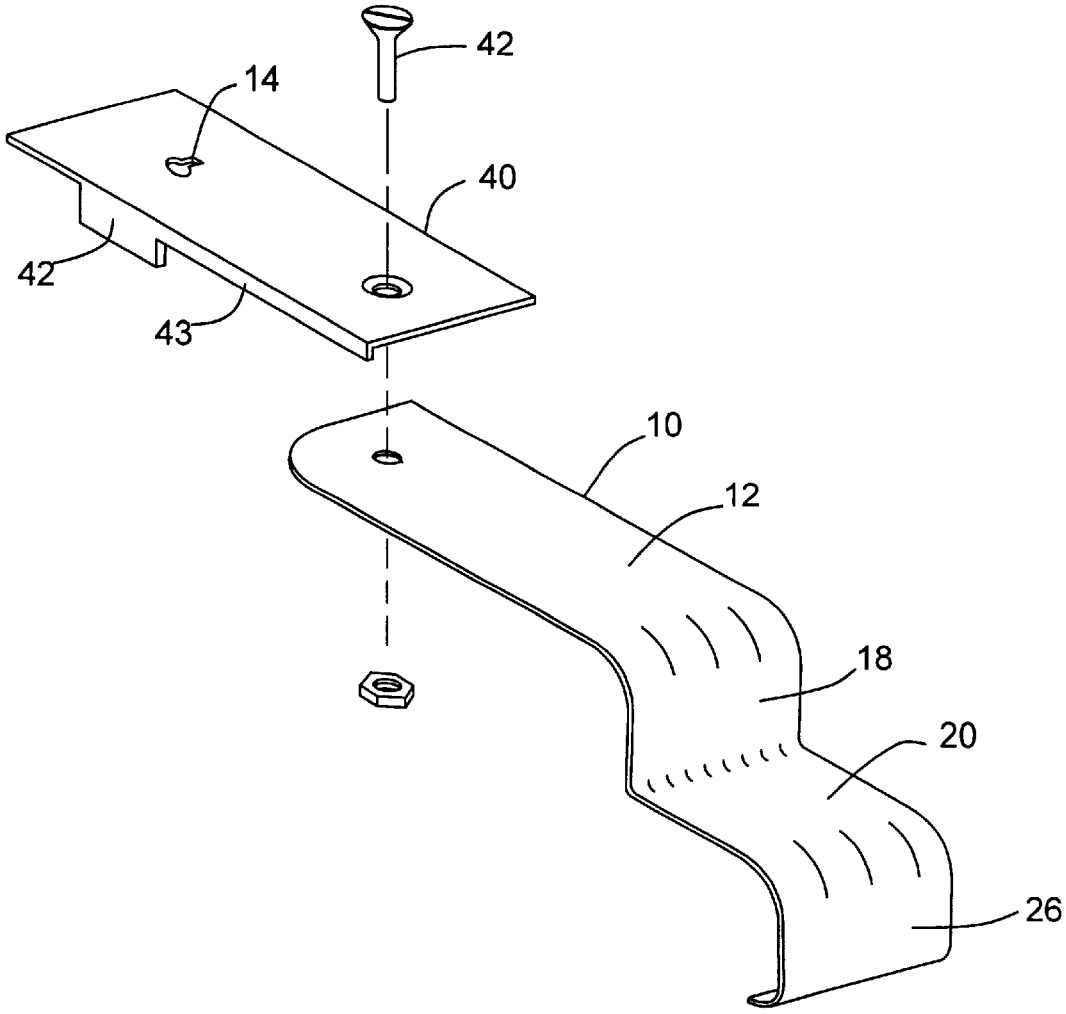
FIGS. 3 is an exploded orthographic view of a preferred embodiment of the invention including a swiveling mounting plate.

FIG. 3 illustrates a preferred embodiment of the invention including a mounting plate 40. The mounting plate 40 is secured to the tool body 10 by a threaded fastener 42 passing through holes in both the mounting plate 40 and tool body 10. The two parts are secured in a manner to allow relative rotation about the fastener 42. The head of the fastener 42 is flush with the upper surface of the mounting plate 40 to allow the mounting plate 40 to be secured flush to a flat surface. Alternative fastening means performing the same functions are known to those skilled in the art. The mounting plate includes a mounting hole 14 for securing the mounting plate to a wall structure. The mounting plate also includes a stop rail 43 to limit rotation of the tool body 10 and a hammer plate 42 to ease removal of the mounting plate 40 when the mounting plate is to be removed from a mounting fastener in the keyhole shape mounting hole 14. This embodiment allows the mounting plate 40 to be secured rigidly to a wall structure while allowing the tool body 10 to be rotated either away from or, alternatively, under the edge of a sheathing section placed against the wall structure adjacent the mounting plate 40. This operation is shown in FIG. 6. In other embodiments, a spring is secured between the tool body and mounting plate to spring load the tool body in position while allowing temporary movement.

FIGS. 4 to 7 illustrate various different operations made possible with a single device configured as the present invention. The tool body 10 is temporarily secured to a wall structure 50 by a fastener 51 passing through the tool body mounting hole 14. Any of a variety of fasteners typically used in this type of work can be used for this purpose. A keyhole shaped mounting hole is preferred to allow subsequent removal of the tool body without completely removing the fastener. In FIG. 4, the tool body 10 is mounted on the face of sheathing 52 previously secured to a ceiling wall structure 50. The fastener should be placed sufficiently distant from the edge of the sheathing 52 to prevent cracking or blowout if that is likely with the particular sheathing used. The tool body upper support length 11 (FIG. 1) should be sufficient to allow proper placement of the fastener and also provide an adequate remaining length of exposed upper support surface 61 to capture the edge of the sheathing section to be held 53. For installing gypsum wall board or construction plywood an upper support length of at least ¼ inches is desired. Most preferably, the upper support length is in the range of 1 (one) to 3 (three) inches. A length greater than 5 (five) is unnecessary and detrimentally adds to weight and difficulty in handling, particularly in overhead situations. The tool body 10 should also have sufficient supporting length opposite the mounting hole 14 to reduce leverage on the fastener. Such a support length of about 1.5 inches is appropriate in most situations. In this configuration, a sheathing section may be easily slipped onto the exposed upper support surface until butting against the sheathing edge to be retained there adjacent the wall structure 50. The first and second guide surfaces 16, 24 guide the edge of the sheathing into position. The guide surfaces preferably have an outer radius of at least ½ inches for this purpose. While the support surfaces will function in the same manner regardless of the guide surfaces, a smaller guide radius may result in sticking or jamming of the sheathing against the tool body. Less preferably, the guide surfaces may consist of one or more flat surfaces inclined with respect to the support surfaces.

In FIG. 5, the tool body 10 is secured in the manner discussed above, but directly to the wall structure 50; the upper support surface being flush with the exposed ceiling surface. The butting surface 18 is aligned adjacent and parallel the desired edge line of the sheathing to be secured. The lower support surface 20, inherently spaced the offset dimension from the wall structure, now comes into play to support an edge of a sheathing section 53. The offset dimension should be at least the predetermined thickness of the particular sheathing to be supported. The offset dimension may be as much as an inch or more greater than the sheathing thickness and still satisfactorily support the sheathing prior to final lateral adjustment and permanent fastening. The lower support length 22 is preferably 2 (two) inches for use with gypsum wallboard and plywood. A sheathing section 53 is easily slipped onto the exposed lower support surface 20, pushed against the butting surface 18, and retained there adjacent the wall structure 50. If the first guide surface 16 is of large radius, the butting surface 18 may be reduced to line contact at the end of the lower support surface. While not preferred, this is adequate in many cases to provide guidance for the sheathing edge location.

FIG. 6 depicts a plan view of two different configurations of the tool body supporting a sheathing section 53. At the top edge 55 in the figure two rigid tool bodies 10 are secured retaining an edge of the sheathing section 53. At the bottom edge 56 are secured two tool bodies configured as in FIG. 3 with a separate mounting plate 40. All four tool bodies are mounted before handling the sheathing. The sheathing section is then first slipped into the fixed tool bodies at the top edge 55. The sheathing section bottom edge is then lifted into the position shown, against the ceiling wall structure. In this operation, the tool bodies 10 at the bottom edge 56 are first positioned rotated into the position shown, away from the sheathing edge. Once the sheathing section is in place, the tool bodies 10 are the rotated into a supporting position 62 under its edge (dashed configuration). This operation may be performed by a single worker with any particular sheathing section that can be lifted over the head. As mentioned above, the support surfaces are preferably parallel to the wall structure to maximize support of the sheathing edge. However, where the edge strength of the sheathing permits, a slightly downward angled support surface is acceptable and may assist in guiding the sheathing edge into place.

Figure 7:
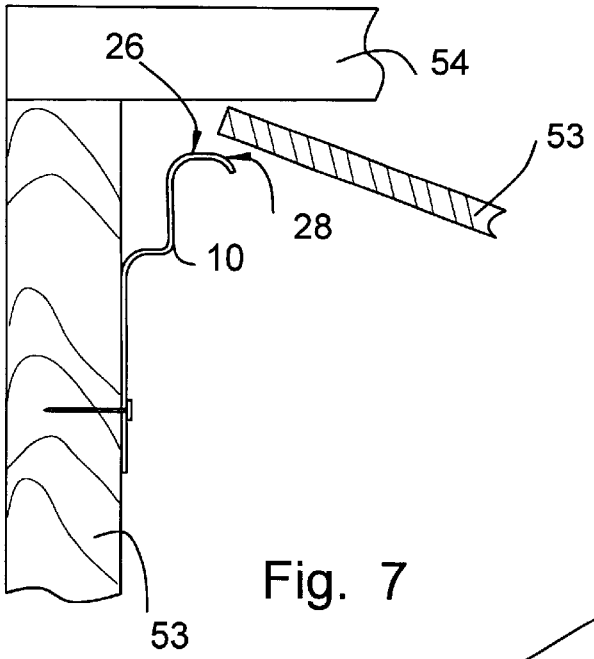
FIGS. 7 and 8 depict various operations using the embodiment of FIG. 1 to install wallboard on ceilings.
Figure 8:
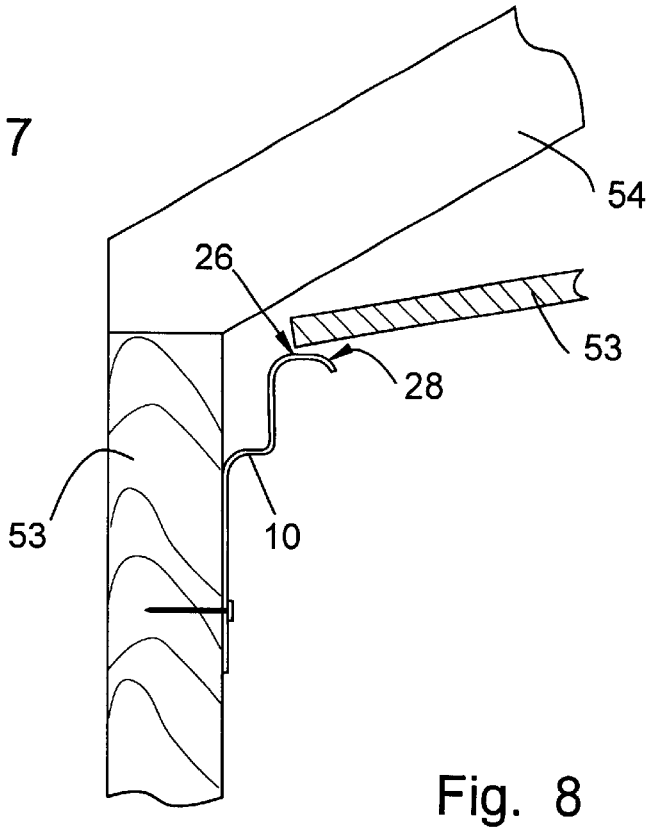

FIGS. 7 and 8 depict operations of the tool body for installation of sheathing onto flat and inclined ceilings. In both configurations, the tool body is mounted on an adjacent vertical wall structure 53 with the lateral support surface 26 spaced from a ceiling 54. The lateral support surface 26 and third guide surface 28 operate in the same manner as discussed regarding the support lower support surface and second guide surfaces. The curvature of the guide surfaces reduce the effective area of the lateral support surface 26. To perform in all the various configurations shown, it is necessary that at least some portion of the lateral guide surface is on a plane orthogonal to the lower support surface. In all of the configurations shown in these figures, the tool body and mounting plate is secured by a fastener passing through a mounting hole. Alternative means of mounting are also contemplated. One such is a solid spike integral with, and extending from, the upper support surface or mounting plate. Other means of mounting will be obvious to one skilled in the art.

The present invention is designed to assist in installation of rigid sheathing materials such as gypsum wallboard or plywood and similar materials. As used here the term "sheathing" means such rigid materials capable of supporting their own weight when supported at the edges of conventionally sized sections or pieces. For contrast, sheathing does not herein include such flexible materials as thin films such as vapor barriers often used in building construction.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A sheathing installation tool capable of supporting sheathing materials on vertical, horizontal and inclined walls comprising:

an upward facing first support surface;

mounting means for mounting the first support surface on a wall surface;

a downward inclined first guide surface extending from the first support surface;

a butting surface extending downward from the guide surface;

an upward facing second support surface extending from the butting surface;

a downward inclined second guide surface extending from the second support surface;

the second support surface offset from the first guide surface a distance greater than or equal a predetermined sheathing thickness.

2. The tool of claim 1, wherein:

at least a portion of the second support surface is parallel to the first guide surface.

3. The tool of claim 2, further comprising:

a third support surface extending perpendicularly from the second guide surface.

4. The tool of claim 3, further comprising:

a third guide surface extending from the third support surface.

5. The tool of claim 4, wherein:

each guide surface is an curved surface.

6. A sheathing installation tool capable of supporting sheathing materials on vertical, horizontal and inclined walls comprising:

an upward facing first support surface;

a downward inclined first guide surface extending from the first support surface;

a butting surface extending downward from the guide surface;

an upward facing second support surface extending from the butting surface;

a downward inclined second guide surface extending from the second support surface;

the second support surface offset from the first guide surface a distance greater than or equal a predetermined sheathing thickness; and the first support surface having a mounting hole and a support length, between the mounting hole and the first guide surface, in the range of 1 to 3 inches.

7. The tool of claim 6, wherein:

the second support surface has a length of 2 inches.

8. The tool of claim 7, wherein:

the predetermined sheathing thickness is in the range of ½ to ¾ inch.

9. The tool of claim 8, further comprising:

a metallic tool body having a thickness of 3/32 inch;

all surfaces integral to the tool body.

10. The tool of claim 9, wherein:

the mounting hole has a key hole shape.

11. The tool of claim 1, further comprising:

a mounting plate rotatably secured to the first support surface.

12. The tool of claim 11, wherein:

the mounting has a mounting hole.

13. The tool of claim 12, wherein:

the mounting hole has a keyhole shape.

14. A sheathing installation tool capable of supporting sheathing materials on vertical, horizontal and inclined walls comprising a mounting plate having mounting means for mounting the mounting plate to a wall surface;

a first support surface rotatably secured to the mounting plate and parallel to the mounting plate;

a butting surface extending downward from the first support surface; and a second support surface extending from the butting surface spaced from the first support a distance in the range of ½ to ¾ inch.

15. A sheath installation tool capable of supporting sheathing materials on vertical, horizontal and inclined walls comprising:

a first support surface;

a second support surface spaced a predetermined sheathing thickness from the first support surface;

the first and second support surfaces co-joined by a butting surface;

a lateral support surface extending laterally from the second support surface; and means of mounting the first support surface to a flat structure.

16. The tool of claim 15, wherein:

the predetermine sheathing thickness is in the range of ½ to ¾ inch.

* * * * *